US005370348A

United States Patent [19]

Toth

[11] Patent Number: 5,370,348

[45] Date of Patent: Dec. 6, 1994

[54] OARLOCK LANTERN HOLDER DEVICE MOVABLE BETWEEN INBOARD AND OUTBOARD POSITIONS

[76] Inventor: John A. Toth, 6166 Elyria Ave., Elyria, Ohio 44035

[21] Appl. No.: 103,864

[22] Filed: Aug. 9, 1993

[51] Int. Cl.[5] ..... A47F 5/00

[52] U.S. Cl. ..... 248/289.1; 248/310; 248/313

[58] Field of Search ..... 248/313, 288.1, 291, 248/289.1, 285, 283, 310

[56] References Cited

U.S. PATENT DOCUMENTS

| | | | |
|---|---|---|---|
| 339,148 | 4/1886 | Chvala | 248/310 X |
| 516,925 | 3/1894 | Gedies | 248/288.1 |
| 936,927 | 10/1909 | McCallum | 248/313 X |
| 1,007,062 | 10/1911 | Carlson | 248/313 |
| 1,104,352 | 7/1914 | Erlandsson | 248/283 X |
| 1,345,252 | 6/1920 | Rubin | 248/289.1 |
| 1,664,658 | 4/1928 | Blazer | 248/289.1 X |
| 1,908,287 | 5/1933 | Elshoff | 248/289.1 X |
| 2,508,974 | 5/1950 | Soditch | 248/291 |
| 2,559,003 | 7/1951 | Brow | 240/52 |
| 2,598,130 | 5/1952 | Mallison | 248/226 |
| 3,341,163 | 9/1967 | Honig | 248/291 |
| 3,843,082 | 10/1974 | Garrett | 248/226 E |
| 3,969,620 | 7/1976 | Brooks | 248/291 |
| 4,515,335 | 5/1985 | DeRosett | 248/231.5 |

*Primary Examiner*—J. Franklin Foss
*Attorney, Agent, or Firm*—John R. Flanagan

[57] ABSTRACT

An oarlock lantern holder device for use in mounting a lantern on a boat gunwale includes an elongated arm and a horizontal split-ring clamp for clamping and holding a lantern and connected to the arm. A vertical shaft portion of the arm is mountable to an oarlock of the boat gunwale for slidably and pivotably moving the arm relative to the oarlock and thereby mounting the arm, split-ring clamp and the lantern therewith for undergoing swinging movement between inboard and outboard positions relative to the boat gunwale.

19 Claims, 1 Drawing Sheet

OARLOCK LANTERN HOLDER DEVICE MOVABLE BETWEEN INBOARD AND OUTBOARD POSITIONS

BACKGROUND OF THE INVENTION

1. Field of the Invention

The present invention generally relates to a devices for holding lanterns, and more particularly, is concerned with an oarlock lantern holder device for mounting a lantern to a boat such that the lantern can be moved between inboard and outboard positions.

2. Description of the Prior Art

Prior art lantern holder devices for boats, such as small pleasure boats, generally feature a lantern holder and a clamp for attaching the lantern holder to a side or the gunwale of the boat. U.S. Pat. No. 2,550,003 to Brow discloses one example of such a device. The Brow patent discloses a lantern holder having a base for supporting a lantern, a clamp for attaching the base to the boat gunwale and a reflecting hood that partially encloses the lantern and rotatably mounts to the base.

U.S. Pat. No. 2,598,130 to Mallison discloses another example of a boat mounted lantern holder device. This device also employs a fixed clamp which attaches to the boat gunwale. The fixed clamp has an outboard vertical prong for engaging a bottom rolled lip at the base of a lantern. The clamp also has a series of "J" shaped slots distributed from an inboard to outboard direction for receiving and holding a wire handle or bail which is typically attached to a lantern. The lantern, in Mallison, pivots about its bottom rolled lip that engages with the above-described outboard vertical prong of the clamp. The wire handle engages one of the "J" slots to hold the lamp at a desired orientation. Thus, the lantern in Mallison can pivot about a horizontal axis allowing the operator to direct light rays out across the water's surface or down into the water.

U.S. Pat. No. 3,843,082 to Garrett discloses still another boat mounted lantern holder device. It features a cylindrical receptacle for holding the lantern and a hanger connected to the receptacle. The hanger in Garrett is fashioned from a strip of resilient material and is adapted for fitting over and around the gunwales of boats of modern construction which have broad top surfaces. Garrett also features slots mounted to the top of the hanger for receiving and retaining the lantern handle or bail so as to prevent accidental displacement.

While the above described devices are useful for securely mounting lanterns to the boats, none of these prior art devices allow the operator to selectively change the lantern between an inboard position and an outboard position. Consequently, a need exists for an improved lantern holder device for boats that allows the operator to so adjust the position of the lantern.

SUMMARY OF THE INVENTION

The present invention provides an oarlock lantern holder device designed to satisfy the aforementioned needs. The oarlock lantern holder device of the present invention employs an elongated arm that is connected to a lantern holding clamp at one end of the arm and pivotably mounted to the oarlock on the gunwale of the boat at the other end of the arm or to a separate mounting bracket where no oarlock is available. The arm and lantern therewith are thus adapted for undergoing pivotal movement from an inboard position to an outboard position relative to the boat gunwale.

Accordingly, the present invention is directed to a lantern holder device for use in mounting a lantern on a boat having a gunwale. The lantern holder device comprises: (*a*) means for holding a lantern; and (*b*) an elongated arm rigidly connected to and extending from the lantern holding means and being pivotally mountable to a gunwale of a boat for moving the lantern holding means and a lantern therewith between inboard and outboard positions relative to the boat gunwale.

The elongated arm includes an inner horizontal portion, an outer horizontal portion and a middle vertical portion rigidly interconnecting the inner and outer horizontal portions and positioning the inner horizontal portion at a higher level than the outer horizontal portion. The elongated arm also includes a vertical shaft rigidly attached to an inner end of the inner horizontal portion and extending vertically downwardly therefrom.

The lantern holding means includes a horizontal split-ring clamp capable of receiving and clamping about the lantern. The clamp is attached to the middle vertical portion of the elongated arm and extends outwardly therefrom in overlying relation and spaced above the outer horizontal portion of the arm. The clamp includes a resilient ring having an inner surface, an outer surface and a pair of adjacent ends, and a pair of parallel tabs each extending outwardly from one of the adjacent ends of the ring. The tabs have respective holes aligned with one another. The clamp also includes an adjustable element disposed through the holes and being operable to pull the tabs toward one another and thereby reduce the size of the ring and tighten said ring about the lantern.

As an optional feature, the lantern holder device also comprises a pivot mounting bracket mountable to the boat gunwale where an oarlock is not available for use or the lantern holder device is to be used in other applications. The pivot mounting bracket slidably and pivotably receives the vertical shaft of the elongated arm. The pivot mounting bracket includes a body having a vertical hole therethrough for receiving the vertical shaft of the main bracket arm and means for fastening the body of the pivot mounting bracket to a support structure, such as the boat gunwale.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
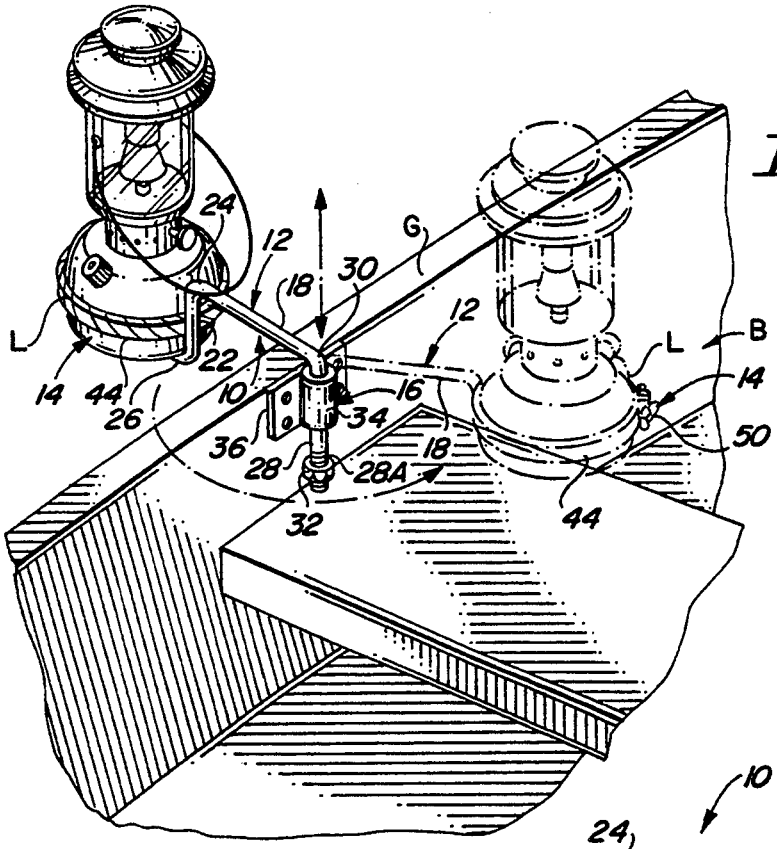
FIG. 1 is a perspective view showing the lantern holder device mounted on the gunwale of a boat using a mounting bracket that is separate from an oarlock on the boat.
Figure 4:
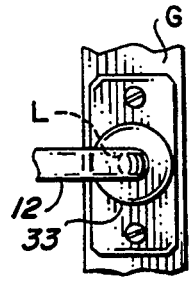
FIG. 4 is a fragmentary top plan view showing the arm of the lantern holder device mounted to the oarlock on the gunwale of the boat.

Referring to the drawings and particularly to FIG. 1, there is illustrated an oarlock lantern holder device, generally designated 10, of the present invention. The lantern holder device 10 is shown attached to a gunwale G of a boat B. Basically, the lantern holder device 10 includes an elongated arm 12 and means in the form of a horizontal split-ring clamp 14 for holding the lantern L. In non-boat applications or in instances where an oarlock is not available, a pivot mounting bracket 16 is provided for mounting to a support structure, such as the inboard side of the boat gunwale G. The mounting bracket 16 slidably and pivotably supports the elongated arm 12 such that the arm 12 can undergo vertical sliding movement relative to the mounting bracket 16 between lowered and raised positions, as respectively shown in solid and phantom line forms in FIG. 2, and undergo horizontal swinging movement about the mounting bracket 16 between inboard and outboard positions relative to the boat gunwale G, as respectively shown in phantom and solid line forms in FIG. 1. In FIG. 4, the most common application for the lantern holder device 10 is illustrated wherein the elongated arm 12 is mounted directly in an oarlock L on the gunwale G of the boat. In this application, no separate mounting bracket 16 is required. Thus, it should be understood that although the arm 12 will be described hereinafter in conjunction with the mounting bracket 16, the latter is considered to be only an optional feature of the present invention.

Figure 2:
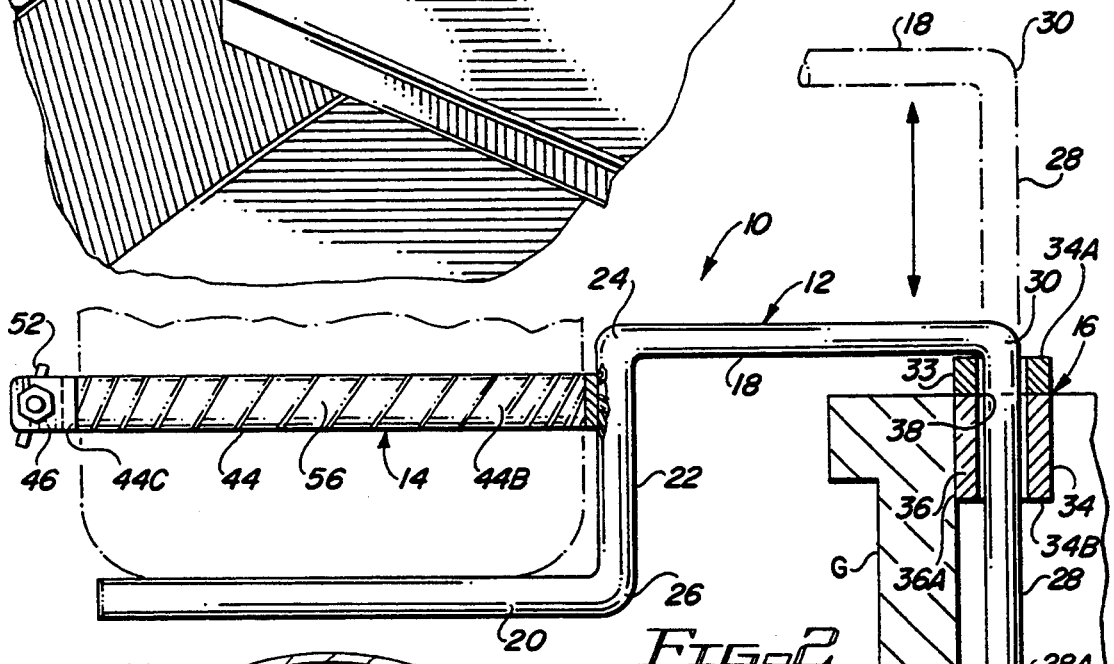
FIG. 2 is a side elevational view of the lantern holder device of FIG. 1.
Figure 3:
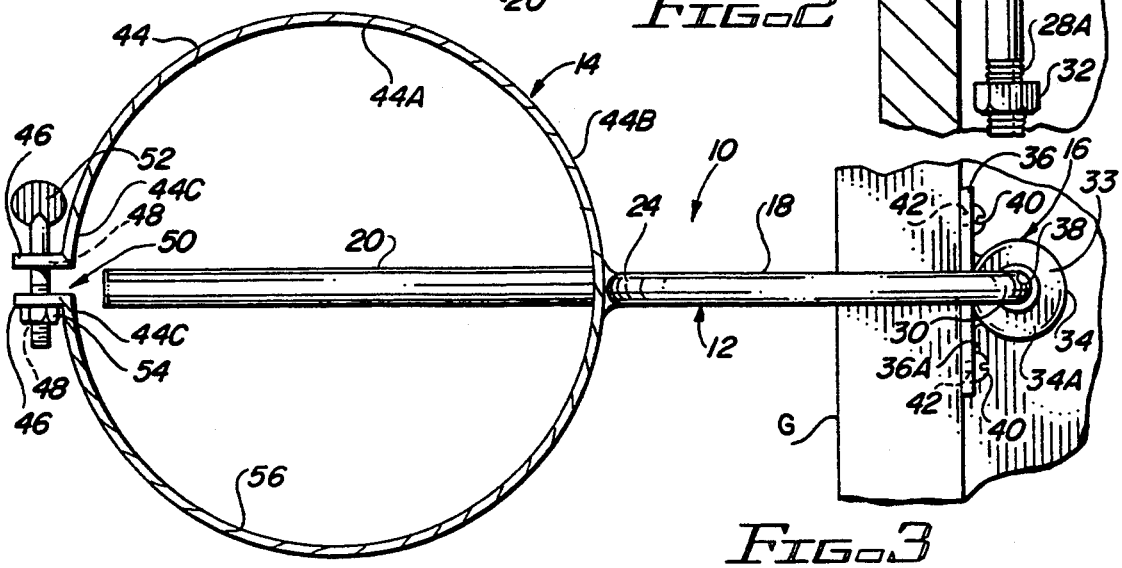
FIG. 3 is a top plan view of the lantern holding device of FIG. 2.

Referring to FIGS. 1–3, the elongated arm 12 of the lantern holder device 10, preferably is a one-piece structure formed from a cylindrical metal rod. The arm 12 includes an inner horizontal portion 18, an outer horizontal portion 20 and a middle vertical portion 22. The middle vertical portion 22 is disposed between and integrally and rigidly interconnects the inner and outer horizontal portions 18, 20 at substantially right-angled upper and lower bends 24, 26 in the arm 12 (which are the upper and lower ends of the middle vertical portion 22) so as to position the inner horizontal portion 18 at a higher level than the outer horizontal portion 20. As seen in FIG. 2, the inner and outer horizontal portions 18, 20 extend in opposite directions away from the middle vertical portion 22.

The elongated arm 12 of the device 10 also includes a vertical shaft portion 28 rigidly attached to an inner end of the inner horizontal portion 18 at a substantially right-angled inner bend 30. The vertical shaft portion 28 extends vertically downwardly from the inner end of the inner horizontal portion 18 into the mounting bracket 16. The pivot mounting bracket 16 slidably and pivotably supports the main bracket arm 12 by its vertical shaft portion 28. The vertical shaft portion 28 has a lower threaded portion 28A that receives a stop nut 32. Also, an annular bushing 33 made of a resilient compressible material, such as rubber, is inserted over the vertical shaft portion 28 and rests upon the top end of the mounting bracket 16 (or the gunwale G over the oarlock L in FIG. 4.). The presence of the bushing 33 will reduce the generation of noise due to frictional contact as the arm 16 pivots relative to the boat gunwale G or some other support structure.

The pivot mounting bracket 16 includes a body 34 and a mounting plate 36. The body 34 has a cylindrical configuration with spaced top and bottom surface 34A, 34B and a cylindrical passage 38 extending vertically from the top surface 34A to the bottom surface 34B. The passage 38 receives therethrough the vertical shaft portion 28 of the elongated arm 12. The mounting plate 36 has a pair of flat opposite surfaces 36A and is rigidly attached, such as by welding, to the body 34 and is, in turn, fastened to the boat gunwale G (or some other support structure) by screws 40 inserted through holes 42 defined in the mounting plate 36.

It should be apparent that pivot mounting bracket 16 could be mounted on either the inboard or the outboard side of the gunwale G. Further, the body 34 and the mounting plate 36 of pivot mounting bracket 16 could be bonded or even integral as for example by being formed from a cast, forged or molded element.

Referring to FIGS. 1–3, the horizontal split-ring clamp 14 is capable of receiving and clamping about the base of the lantern L. The clamp 14 is attached to the middle vertical portion 22 of the elongated arm 12 and extends horizontally outwardly therefrom in overlying relation to, and spaced and centered directly above, the outer horizontal portion 20 of the arm 12.

More particularly, the clamp 14 includes a resilient split-ring 44 having an inner surface 44A, an outer surface 44B and a pair of adjacent ends 44C. A pair of parallel tabs 46 are integrally attached to the ends 44C of the ring 44 and extend outwardly therefrom. The tabs 46 have respective holes 48 therethrough being aligned with one another. The clamp 14 also includes an adjustable fastener 50 disposed through the holes 48 of the tabs 46 and being operable to pull the tabs 46 toward one another and thereby flex and reduce the diameter size of the resilient split-ring 44 and tighten the split-ring 44 about the lantern L. As an example, the adjustable fastener 50 can be the type which includes a thumb screw 52 and a wing nut 54. The split-ring 44 remains in an open position unless fastener 50 is adjusted to pull tabs 46 together.

The split-ring 44 also preferably includes a strip of resilient tape 56 wrapped around and along the split-ring 44. The resilient tape 56 aids in clamping and securing the lantern L and protects it from any damage that could result from hard metallic contact.

As illustrated in FIGS. 1–3, the split-ring clamp 14 receives and holds the base of the lantern L while lantern L rests on outer horizontal portion 20 of the elongated arm 12. The pivot mounting bracket 16 slidably and pivotably receives the vertical shaft portion 28 of the arm 12. The stop nut 32 is treaded to the lower threaded end portion 28A of vertical shaft portion 28 and prevents it from disengaging from the pivot mounting bracket 16. An operator can readily rotate the lantern L from the outboard position to the inboard position shown in FIG. 1 about a vertical axis defined by the vertical shaft portion 28 and the mounting bracket 16. However, in order to avoid contact with the boat gunwale G, the arm 12 must be lifted vertically until the outer horizontal portion 20 will clear the gunwale G in order to then swing the arm 12 over the gunwale G.

It is thought that the present invention and its advantages will be understood from the foregoing description and it will be apparent that various changes may be made thereto without departing from the spirit and scope of the invention or sacrificing all of its material advantages, the form hereinbefore described being merely a preferred or exemplary embodiment thereof.

I claim:

1. A lantern holder device for use in mounting a lantern on a support structure, said device comprising:
(a) means for holding a lantern; and
(b) an elongated arm connected to and extending from said lantern holding means and being pivotally mountable to a support structure for moving said lantern holding means and a lantern therewith between inboard and outboard positions relative to the support structure;
(c) said arm including an inner horizontal portion, an outer horizontal portion and a middle vertical between and rigidly interconnecting said inner and outer horizontal portions at opposite ends of said middle vertical portion and positioning said inner horizontal portion at a higher level than said outer horizontal portion, said inner and outer horizontal portions extending in opposite directions away from said middle vertical portion;
(d) said lantern holding means being attached to said middle vertical portion and disposed above said outer horizontal portion.

2. The device of claim 1 wherein said arm is in the form of an elongated cylindrical rod having a plurality of bends formed therein.

3. The device of claim 1 wherein said arm also includes a vertical shaft rigidly attached to an inner of said inner horizontal portion and extending vertically downwardly therefrom.

4. The device of claim 3 further comprising:
a pivot mounting bracket mountable to the boat gunwale for slidably and pivotably receiving said vertical shaft of said arm.

5. The device of claim 4 wherein said pivot mounting bracket includes a body having a vertical hole therethrough for receiving said vertical shaft of said arm and means for fastening said body of said pivot mounting bracket to the support structure.

6. The device of claim 5 wherein said vertical hole is in the form of a vertical cylindrical passage having an inside diameter greater than an outside diameter of said vertical shaft of said arm.

7. The device of claim 5 wherein said fastening means includes a substantially flat mounting plate having a pair of substantially parallel surfaces, said mounting bracket body being attached to one of said surfaces, said mounting plate also having a plurality of holes extending therethrough between said surfaces for attaching said pivot mounting bracket to the support structure.

8. The device of claim 3 wherein said vertical shaft has a threaded portion at a lower end thereof for receiving a stop nut.

9. The device of claim 3 wherein said lantern holding means includes a horizontal split-ring clamp capable of receiving and clamping about the lantern, said clamp being attached to said middle vertical portion of said arm and extending outwardly therefrom in overlying relation to and spaced above said outer horizontal portion of said arm.

10. The device of claim 9 wherein said clamp includes:
a resilient split-ring having an inner surface, an outer surface and a pair of adjacent ends;
a pair of parallel tabs each extending outwardly from one of said adjacent ends of said split-ring, said tabs having respective holes aligned with one another; and
an adjustable element disposed through said holes and being operable to pull said tabs toward one another and thereby reduce the size of said split-ring and thereby tighten said split-ring about the lantern.

11. The device of claim 10 wherein said adjustable element is a fastener including a thumb screw and a wing nut.

12. The device of claim 10 wherein said clamp also includes tape attached around and along said split-ring.

13. The device of claim 3 further comprising a resilient compressible annular bushing inserted over said vertical shaft of said elongated arm to reduced generation of frictional noise between said arm and the support structure.

14. The device of claim 1 wherein said lantern holding means includes a horizontal split-ring clamp capable of receiving and clamping about the lantern, said clamp being attached to said middle vertical portion of said arm and extending outwardly therefrom in overlying relation to and spaced above said outer horizontal portion of said elongated arm.

15. The device of claim 14 wherein said clamp includes:
a resilient split-ring having an inner surface, an outer surface and a pair of adjacent ends;
a pair of parallel tabs each extending outwardly from one of said adjacent ends of said split-ring, said tabs having respective holes aligned with one another; and
an adjustable element disposed through said holes and being operable to pull said tabs toward one another and thereby reduce the size of said split-ring and thereby tighten said split-ring about the lantern.

16. The device of claim 15 wherein said adjustable element is a fastener including a thumb screw and a wing nut.

17. An oarlock lantern holder device for use in mounting a lantern on a boat having a gunwale with an oarlock, said device comprising:
(a) an elongated bracket arm including an inner horizontal portion, an outer horizontal portion and a middle vertical portion rigidly interconnecting said inner and outer horizontal portions and positioning said inner horizontal portion at a higher level than said outer horizontal portion, and a vertical shaft rigidly attached to an inner end of said inner horizontal portion and extending vertically downwardly therefrom for insertion into the oarlock on the boat gunwale;
(b) a resilient compressible annular bushing inserted over said vertical shaft of said elongated arm to seat upon the oarlock on the boat gunwale to thereby reduced generation of frictional noise between said arm and the boat gunwale; and
(c) a horizontal split-ring clamp for holding a lantern, said clamp being capable of receiving and clamping about the lantern, said clamp being attached to said middle vertical portion of said elongated arm and extending outwardly therefrom in overlying relation and spaced above said outer horizontal portion of said arm;
(d) said vertical shaft of said elongated arm being slidably and pivotally mountable to the oarlock of the boat gunwale whereby said elongated arm, split-ring clamp and a lantern therewith can undergo swinging movement about the oarlock between inboard and outboard positions relative to the boat gunwale.

18. The device of claim 17 wherein said clamp includes:

a resilient split-ring having an inner surface, an outer surface and a pair of adjacent ends;

a pair of parallel tabs each extending outwardly from one of said adjacent ends of said split-ring, said tabs having respective holes aligned with one another; and an adjustable fastener disposed through said holes and being operable to pull said tabs toward one another and thereby reduce the size of said split-ring and thereby tighten said split-ring about the lantern.

19. The device of claim 17 wherein said clamp also includes tape attached around and along said split-ring.

* * * * *